US007753807B2

(12) United States Patent
Nakano

(10) Patent No.: US 7,753,807 B2
(45) Date of Patent: Jul. 13, 2010

(54) GOLF CLUB HEAD

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 293 days.

(21) Appl. No.: 11/976,703

(22) Filed: Oct. 26, 2007

(65) Prior Publication Data

US 2008/0146375 A1 Jun. 19, 2008

(30) Foreign Application Priority Data

Dec. 19, 2006 (JP) ..... 2006-341614

(51) Int. Cl.
*A63B 53/04* (2006.01)

(52) U.S. Cl. ..... 473/335; 473/345; 473/349

(58) Field of Classification Search ..... 473/324–350, 473/287–292
See application file for complete search history.

(56) References Cited

U.S. PATENT DOCUMENTS 4,432,549 A * 2/1984 Zebelean ..... 473/346
4,438,931 A * 3/1984 Motomiya ..... 473/346
5,665,014 A * 9/1997 Sanford et al. ..... 473/345
6,602,149 B1 * 8/2003 Jacobson ..... 473/329
7,025,692 B2 * 4/2006 Erickson et al. ..... 473/335
2006/0014592 A1 1/2006 Sugimoto

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head having a face portion, a crown portion, a sole portion, a side portion and a hosel portion comprises: a face component made of a titanium alloy and forming a major part of the face portion; a hosel-and-heel component made of a titanium alloy and forming a heel-side part of the sole portion and side portion and the hosel portion; and a rear component made of a magnesium alloy and forming a rear part of the head. The above-mentioned heel-side part of the sole portion formed by the hosel-and-heel component extends towards the toe of the head and intersects a vertical straight line passing through the center of gravity of the club head so as to form a major part of the sole portion.

8 Claims, 5 Drawing Sheets

GOLF CLUB HEAD

BACKGROUND OF THE INVENTION

The present invention relates to a golf club head, more particularly to a hollow structure made of a titanium alloy and a magnesium alloy.

In recent years, large-sized wood-type hollow golf club heads are widely used. The weight of a golf club head naturally has an upper limit, therefore, in the case of a large-sized golf club head, the weight margin which can be utilized to optimize the weight distribution or to adjust the positions of the center of gravity and sweet spot and the like, becomes decreased. Thus, the design freedom with respect to the weight distribution is decreased.

In order to solve such problem, a hybrid hollow golf club has been proposed, wherein the main body of the head which is made of a metal material, is provided in the crown portion with an opening in order to reduce the weight, and the opening is closed by a light-weight FRP cover. Such a metal/FRP hybrid head is excellent at design freedom with respect to the weight distribution. However, since the internal energy loss of FRPs or fiber reinforced resins is very large when compared with metal materials, the ball hitting sound becomes dull, and the tone becomes low, further, the decay becomes fast. Therefore, the ball hitting sound of the hybrid heads is usually not preferred by many golfers.

In the US patent application publication No. US 2006-014592-A1, a hollow golf club head is disclosed, wherein a main body of the club head made of a titanium alloy is provided with an opening, and the opening is covered with a thin plate of a magnesium alloy. In this technique, as the covering plate is not a fiber reinforced resin, a preferable hitting sound may be obtained. But, when the size of the main body is considered, the covering plate is small, therefore, it is difficult to increase the weight margin.

SUMMARY OF THE INVENTION

It is therefor, an object of the present invention to provide a golf club head, which has a hollow structure capable of increasing the weight margin, without deteriorating the ball hitting sound.

According to the present invention, a golf club head having a face portion, a crown portion, a sole portion, a side portion and a hosel portion comprises a face component made of a titanium alloy and forming a major part of the face portion, a hosel-and-heel component made of a titanium alloy and forming the hosel portion and a heel-side part of the sole portion and side portion, and a rear component made of a magnesium alloy and forming a rear part of the head, wherein the heel-side part of the sole portion formed by the hosel-and-heel component extends towards the toe of the head and intersects a vertical straight line passing through the center of gravity of the club head so as to form a major part of the sole portion.

In this specification, unless otherwise noted, dimensions, positions and the like relating to the head refer to those under the standard state of the club head.

The standard state is such that the club head is set on a horizontal plane HP so that the axis of the clubshaft(not shown) is inclined at the lie angle while keeping the axis on a vertical plane, and the clubface forms its loft angle with respect to the horizontal plane HP. Incidentally, in the case of the club head alone, the center line of the shaft inserting hole 7*a* can be used instead of the axis of the clubshaft.

The sweet spot s is the point of intersection between the clubface 2 and a straight line N drawn normally to the clubface 2 passing the center of gravity G of the head.

The back-and-forth FB direction is a direction parallel with the straight line N projected on the horizontal plane HP.

The heel-and-toe direction is a direction parallel with the horizontal plane HP and perpendicular to the back-and-forth direction.

The moment of inertia is the lateral moment of inertia around a vertical axis passing through the center of gravity G in the standard state.

DESCRIPTION OF THE PREFERRED EMBODIMENTS

Figure 1:
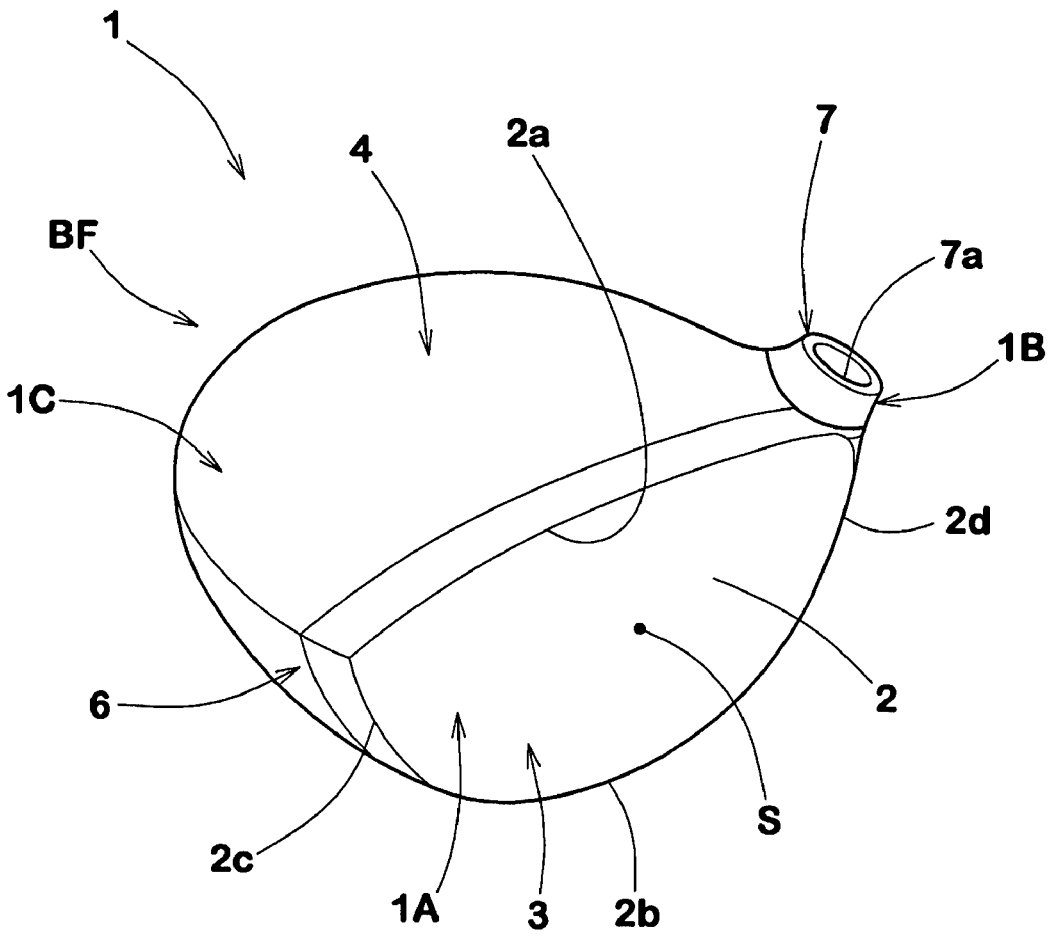
FIG. 1 is a perspective view of a golf club head according to the present invention.

Embodiments of the present invention will now be described in detail in conjunction with accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown).

Thus, the club head 1 is provided with a hollow (i) and a shell structure with the thin wall.

Figure 2:
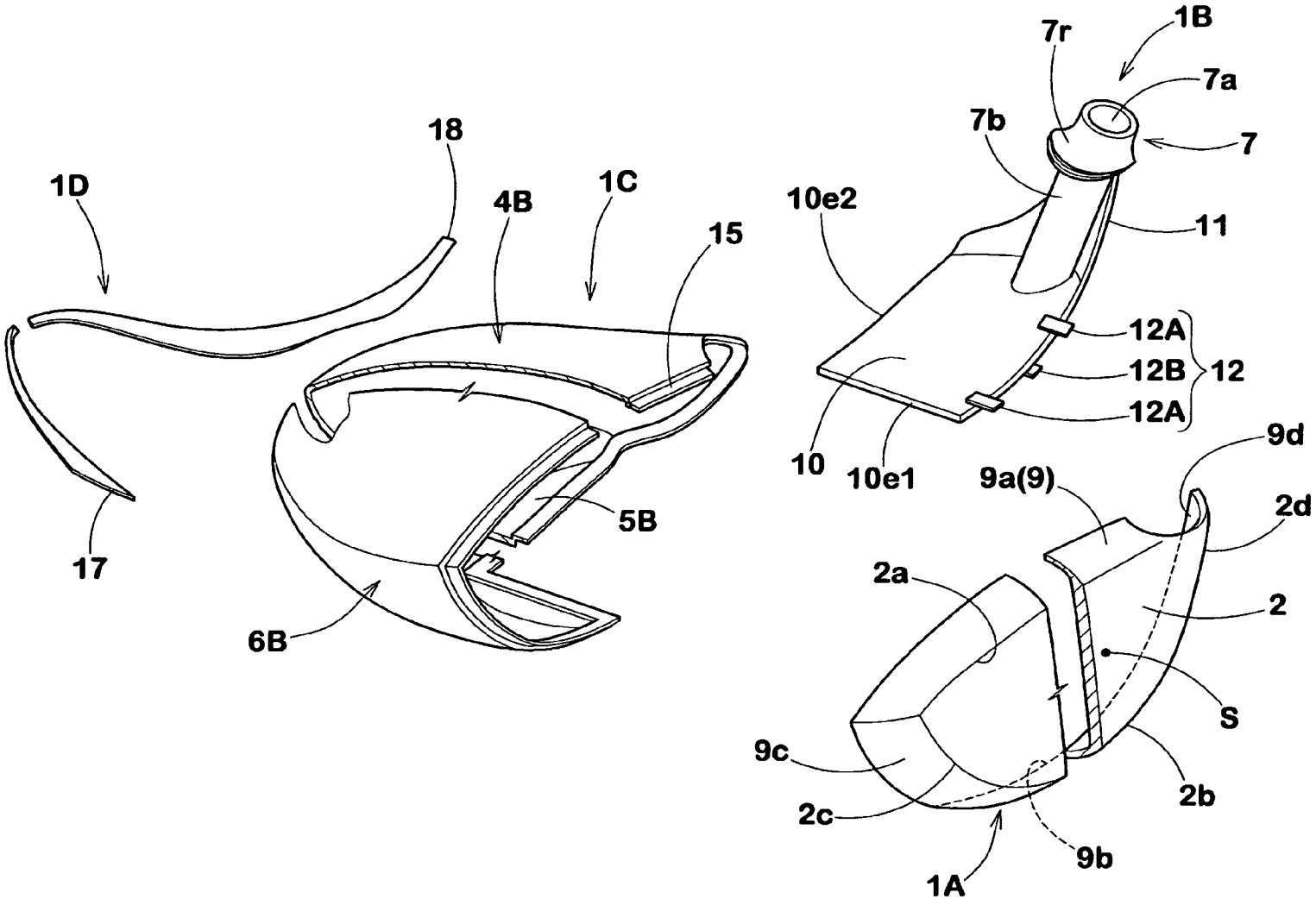
FIG. 2 is an exploded perspective view thereof.
Figure 3:
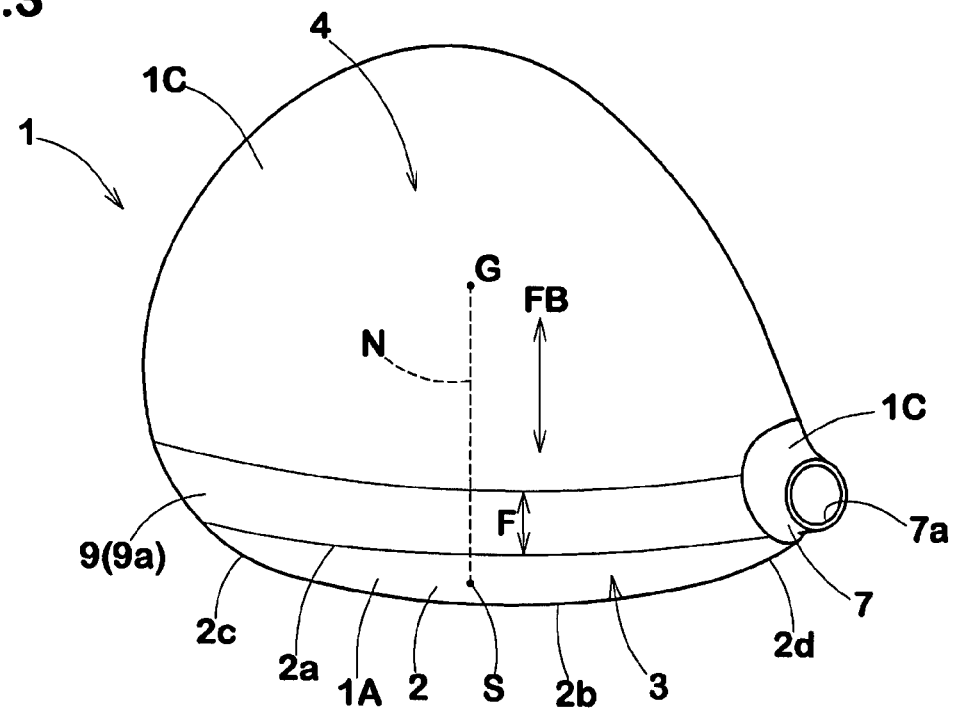
FIG. 3 is a top view of the golf club head.

As shown in FIG. 2, the hosel portion 7 comprises a neck part 7*r* and a tubular part 7*b*. The neck part 7*r* forms a part of the outer surface of the head. The tubular part 7*b* extends into the hollow (i) from the neck part 7*r* to form a major part of a shaft inserting hole 7*a* into which the club shaft is inserted. The tubular part 7*b* in this example reaches to the sole portion.

In the case of a wood-type club head for a driver (#1), it is preferable that the head volume is set in a range of not less than 380 cc, preferably not less than 400 cc more preferably not less than 420 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 470 cc, preferably not more than 460 cc.

The mass of the club head 1 is preferably set in a range of not less than 180 grams, preferably not less than 185 grams in view of the strength, swing balance and traveling distance of the ball, but not more than 220 grams, preferably not more than 215 grams in view of the directionality and traveling distance of the ball.

The club head 1 is as shown in FIG. 2, composed of
a face component 1A made of a titanium alloy,
a hosel-and-heel component 1B made of a titanium alloy,
a rear component 1C made of a magnesium alloy and
an optional weighting component 1D.

Face Component 1A

The face component 1A is to form a major part of the face portion 3 including the sweet spot S. Here, the major part means that 50% or more of the area of the club face 2 is included. Thus, in order to provide strength, a titanium alloy having a high specific tensile strength as well as good workability is used. For example, a beta titanium alloy excellent in strength or alpha-beta titanium alloy excellent in castability is used. More specifically, Ti-6Al-4V, Ti-15V-3Cr-3Al-3Sn, Ti-22V-4Al , Ti-15Mo-5Zr-3Al , Ti-13V-11Cr-3Al, Ti-8Mo-8V-2Fe-3Al, Ti-3Al-8V-6Cu-4Mo-4Zr, Ti-11.5Mo-6Zr-4.5Sn, Ti-15Mo-5Zr and the like can be preferably used.

In this example, the face component 1A forms the entirety of the face portion 3.

The thickness tf of the face portion 3 is preferably set in a range of not less than 1.5 mm, more preferably not less than 2.0 mm, but not more than 5.0 mm, more preferably not more than 4.0 mm, still more preferably not more than 3.5 mm. The thickness tf in this embodiment is substantially constant. But, it is also possible to provide the face portion 3 with a thinner part or parts surrounding the resultant thicker central part to achieve the durability and rebound performance.

Further, the face component 1A in this example, includes turnbacks 9*a*, 9*b*, 9*c* and 9*d*.

The turnbacks 9*a*, 9*b*, 9*c* and 9*d* extend backwards from the edges 2*a*, 2*b*, 2*c* and 2*d* of the club face 2 or face portion 3, respectively, and the turnbacks form front parts of the crown portion 4, sole portion 5 and side portion 6. In order to accommodate the hosel portion 7, a heel-side part of the upper turnback 9*a* is cut off by an arc. Owing to the turnbacks, stress occurring at the junction when hitting a ball is decreased and the durability can be improved. If the size of the turnbacks is too large however, it is difficult to obtain an efficient weight margin and further it is difficult to make it by press molding. Therefore, excepting the above-mentioned cut-off part, the size F of the turnbacks 9 in the back-and-forth direction of the club head is set in a range of not less than 3 mm, preferably not less than 5 mm, more preferably not less than 7 mm, but not more than 30 mm, preferably not more than 25 mm, more preferably not more than 20 mm.

In this example, the turnback is formed along the almost entire length of the peripheral edge of the club face 2. But, the turnback may be formed along only a part of the peripheral edge of the club face 2, for example, only the upper edge 2*a* and lower edge 2*b*. Further, the face component 1A may be made up of the face portion 3 only, namely, there is no turnback.

The face component 1A inclusive of the turnbacks has a one-piece structure formed by press molding of a rolled plate in view of the production efficiency and strength. It is of course possible to form such one-piece structure by forging of a rolled plate, casting of the alloy, or the like.

Hosel-and-Heel Component 1B

Figure 5:
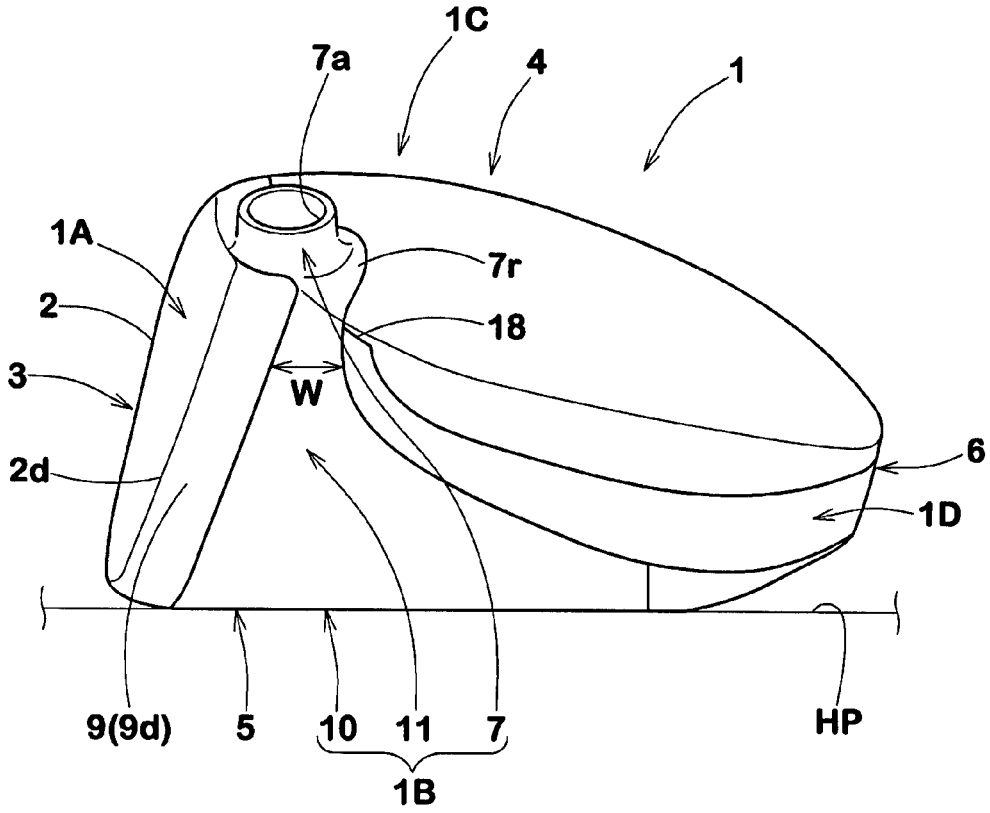
FIG. 5 is a right side view thereof.

As shown in FIG. 2 and FIG. 5, the hosel-and-heel component 1B includes: the above-mentioned hosel portion 7; a heel-side sole plate 10 forming a heel-side part of the sole portion 5; and a heel-side side plate 11 forming a heel-side part of the side portion 6.

Figure 4:
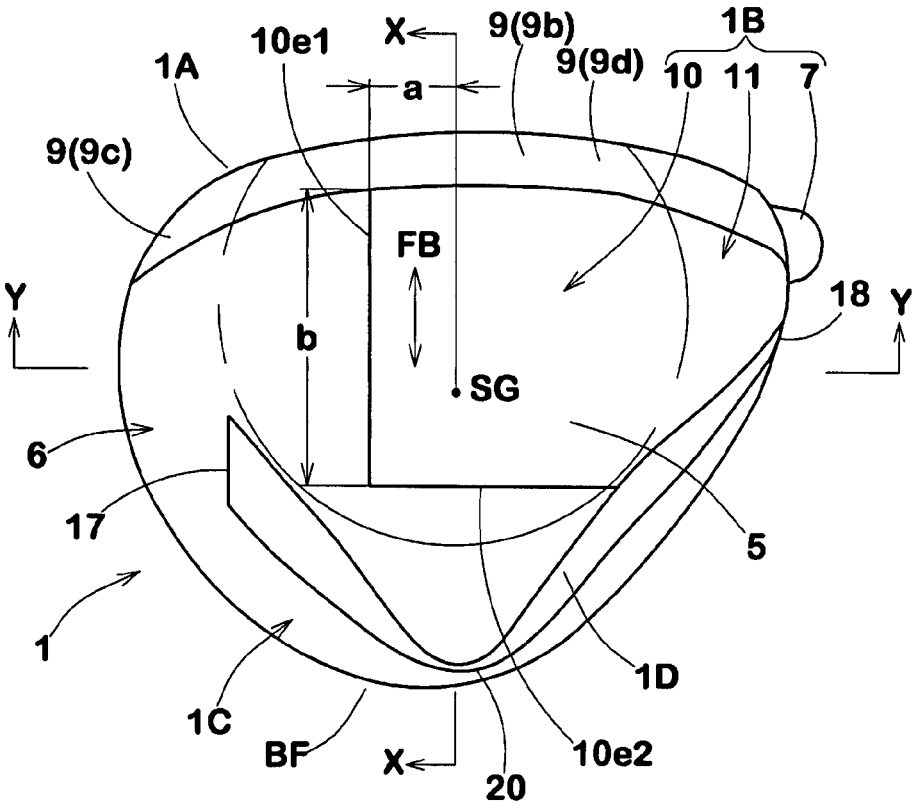
FIG. 4 is a bottom view thereof.

As show in FIG. 4, the heel-side sole plate 10 extends to at least the point SG which is an intersecting point of a vertical straight line passing the center G of gravity of the head with the outer surface of the sole portion 5 under the standard state of the head.

As shown in FIG. 5, the heel-side side plate 11 extends from the underside of the neck part 7*r* of the hosel portion 7 to the heel-side sole plate 10, defining a part of the outer surface of the head, and the horizontal width w thereof measured between the front edge and the rear edge is progressively increased from the crown portion to the sole portion. Between the heel-side side plate 11 and the hosel tubular part 7*b*, a gap may be formed, but in this example, there is no gap, therefore, the heel-side side plate 11 functions as a stay for the hosel tubular part 7*b*.

The hosel portion 7 is subjected to a large torsional moment during down swing, and the heel-side part of the sole portion 5 between the heel and the intersecting point SG is very liable to contact with the ground surface, therefore, in order to provide the strength and rigidity, the hosel-and-heel component 1B has a one-piece structure made of the titanium alloy.

As the titanium alloy of the hosel-and-heel component 1B, the above-mentioned titanium alloys listed in connection with the face component 1A can be used too. The titanium alloy of the hosel-and-heel component 1B can be the same as or different from the titanium alloy of the face component 1A.

In view of the shape of the hosel-and-heel component 1B which is complex when compared with the face component 1A, it is preferred that the hosel-and-heel component 1B is formed by casting. In this case, accordingly, titanium alloys suitable for casting such as Ti-6Al-4V are used.

The front edge of the heel-side side plate 11 is connected with the rear edge of the heel-side turnback 9*d* of the face component 1A. The front edge of the heel-side sole plate 10 is connected with the rear edge of the lower turnback 9*b*.

As shown in FIG. 4, the size (b) of the heel-side sole plate 10 measured in the back-and-forth direction FB from the front edge is preferably set in a range of not less than 20 mm, more preferably not less than 30 mm in order to provide the sole portion 5 with a resistance to scratch, but preferably not more than 80 mm, more preferably not more than 60 mm, still more preferably not more than 50 mm. If the size (b) is too large, as the rear component 1C becomes smaller accordingly, it becomes difficult to obtain an efficient weight margin.

The rear edge 10*e*2 of the heel-side sole plate 10 and the rear edge of the heel-side side plate 11 are connected with the edge of the rear component 1C.

The rear edge 10*e*2 in this example is straight and substantially parallel to the heel-and-toe direction. Aside from such a straight configuration, various configurations such as arc, wave and zigzag can be employed.

In this example, the toe-side edge 10*e*1 of the heel-side sole plate 10 is straight and substantially parallel to the back-and-forth direction FB. Aside from such a straight configuration, various configurations such as arc, wave and zigzag can be employed.

Preferably, the extreme end (toe-side edge 10*e*1) of the heel-side sole plate 10 is spaced apart from the intersecting point SG by a distance (a) of not less than 5 mm, preferably not less than 10 mm towards the toe. However, if the distance (a) is excessively large, it becomes difficult to obtain an effective weight margin. Therefore, the distance (a) is preferably not more than 40 mm, more preferably not more than 30 mm, still more preferably not more than 20 mm.

Figure 7:
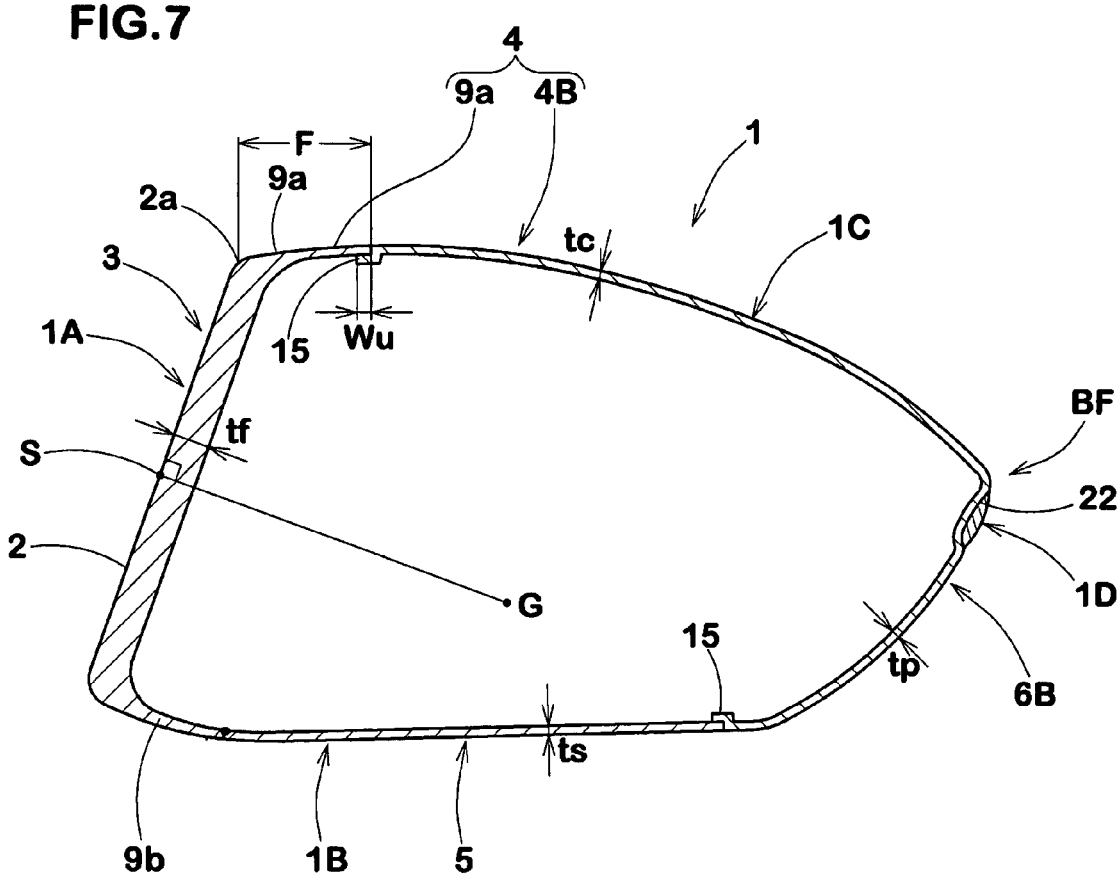
FIG. 7 is a cross sectional view taken along line x-x in FIG. 4.
Figure 8:
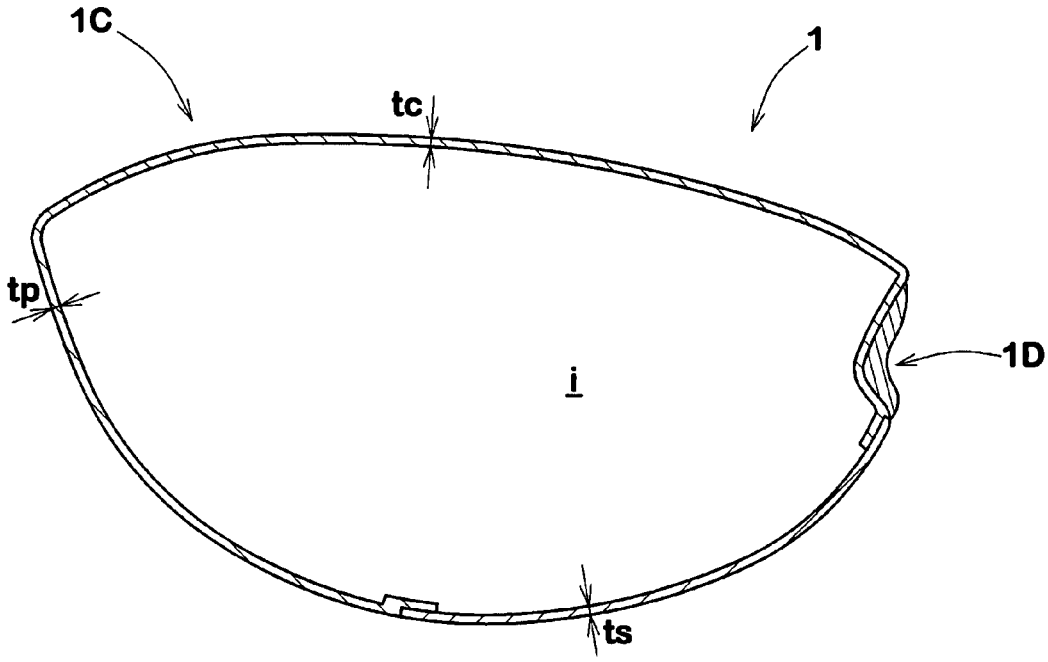
FIG. 8 is a cross sectional view taken along line Y-Y in FIG. 4.

As shown in FIG. 7 and FIG. 8, the thickness ts of the heel-side sole plate 10 is preferably set in a range of not less than 0.4 mm, more preferably not less than 0.5 mm, but not more than 3.0 mm, more preferably not more than 2.5 mm, still more preferably not more than 2.0 mm.

In order to connect the face component 1A with the hosel-and-heel component 1B, welding, soldering and/or adhesive bonding can be employed. But, in view of the joint strength and production efficiency, welding such as plasma welding, Tig welding and laser welding is especially preferred.

In order to facilitate positioning of one of the components 1A and 1B relatively to the other during welding, at least one of them is provided with hooks 12 as shown in FIG. 2. In this example, the hooks 12 are provided on the front edge of the heel-side sole plate 10, and the hooks include inner hooks 12A and outer hook(s) 12B alternately arranged along the edge. The inner hook 12A is to support and position the inner surface of the edge to be jointed. The outer hook 12B is to support and position the outer surface of the edge to be jointed.

Rear Component 1C

The rear component 1C is made of the magnesium alloy and has the largest outer surface area in the components 1A-1C in order to obtain a large weight margin. The rear component 1C in this example is a casting of the magnesium alloy.

In order to achieve weight reduction while preventing a significant decrease in the club head strength, the specific gravity of the magnesium alloy is preferably not less than 1.6, more preferably not less than 1.7, but not more than 2.0, more preferably not more than 1.9. Further, in view of the strength and workability, magnesium alloys including Al and Zn are preferably used. Accordingly, the specific gravity of the rear component 1C is smaller than those (typically 4.4 to 4.8) of the face component 1A and hosel-and-heel component 1B.

The rear component 1C is attached to the rear edge of the assembly of the face component 1A and the hosel-and-heel component 1B, whereby the rear component 1C forms the remaining rear parts of the crown portion 4, side portion 6 and sole portion 5. More specially, the rear component 1C forms:

a rear part 4B of the crown portion 4 connected with the upper turnback 9*a* of the face component 1A;

a rear part 6B of the side portion 6 connected with the toe-side turnbacks 9*c* of the face component 1A and connected with the heel-side side plate 11 of the hosel-and-heel component 1B; and a rear part 5B of the sole portion 5 connected with the heel-side sole plate 10 and the lower turnback 9*b*.

In order to accommodate the neck part 7*r* of the hosel portion 7, the front edge of the rear component 1C is cut off by an arc.

The thickness tc of the rear part 4B of the crown portion 4 is preferably set in a range of not less than 0.3 mm, more preferably not less than 0.4 mm, but not more than 3.0 mm, more preferably not more than 2.0 mm, still more preferably not more than 1.5 mm.

The thickness tp of the rear part 6B of the side portion 6 is preferably set in a range of not less than 0.4 mm, more preferably not less than 0.5 mm, but not more than 3.0 mm, more preferably not more than 2.5 mm.

As shown in FIG. 2 and FIG. 7, the front edge 1Ce of the rear component 1C to be jointed with the face component 1A and hosel-and-heel component 1B is provided with an overlapping part 15 substantially continuously along the edge 1Ce. The outer surface of the overlapping part 15 is stepped from the outer surface of the clubs head by an amount corresponding to the thickness of the rear edge of the assembly.

The overlapping part 15 is overlap jointed with the rear edge of the assembly of the face component 1A and hosel-and-heel component 1B. Preferably, the size Wu of the overlapping part 15 measured in the back-and-forth direction from the front edge to the rear edge is set in a range of not less than 1.0 mm, more preferably not less than 1.5 mm, but not more than 10.0 mm, more preferably not more than 5.0 mm.

In this embodiment, the rear component 1C is fixed to the assembly by the use of an adhesive agent applied between the edge and the overlapping part 15. As to the adhesive agent, for example, cold-curing two-component epoxy resin adhesives, heat-curing one-component epoxy resin adhesives, two-component modified acrylate adhesive, and two-component acrylic adhesive can be used. Especially, a cold-curing two-component epoxy resin adhesive is preferred for the excellent shear strength and peel strength.

As has been explained, a major part of the club head 1 is formed by the magnesium alloy, therefore the weight margin is increased, without deteriorating the ball hitting sound because a FRP component is not used as a major component. Utilizing the increased weight margin a relatively heavy weighting component 1D can be disposed.

The weighting component 1D may be made of a metal material having a specific gravity larger than that of the magnesium alloy of the rear component 1C. Preferably, the specific gravity of the weighting component 1D is set in a range of not less than 7.0, more preferably not less than 10.0, still more preferably not less than 12.0, but not more than 20.0, more preferably not more than 19.0, still more preferably not more than 18.0. For example, stainless steels, tungsten, tungsten alloys, copper alloys, nickel alloys and the like can be used. In particular, tungsten-nickel alloys are preferred for the large specific gravity and lower material cost.

In this embodiment, the weighting component 1D having a shape of tape or ribbon is disposed along the outer surface of the side portion 6 of the rear component 1C. In this case, as shown in FIG. 7 and FIG. 8, the outer surface is preferably provided with a recessed part 22 accommodated to the weighting component 1D, and the weighting component 1D is fitted in the recessed part 22 and bonded thereto by the use of an adhesive agent.

Figure 6:
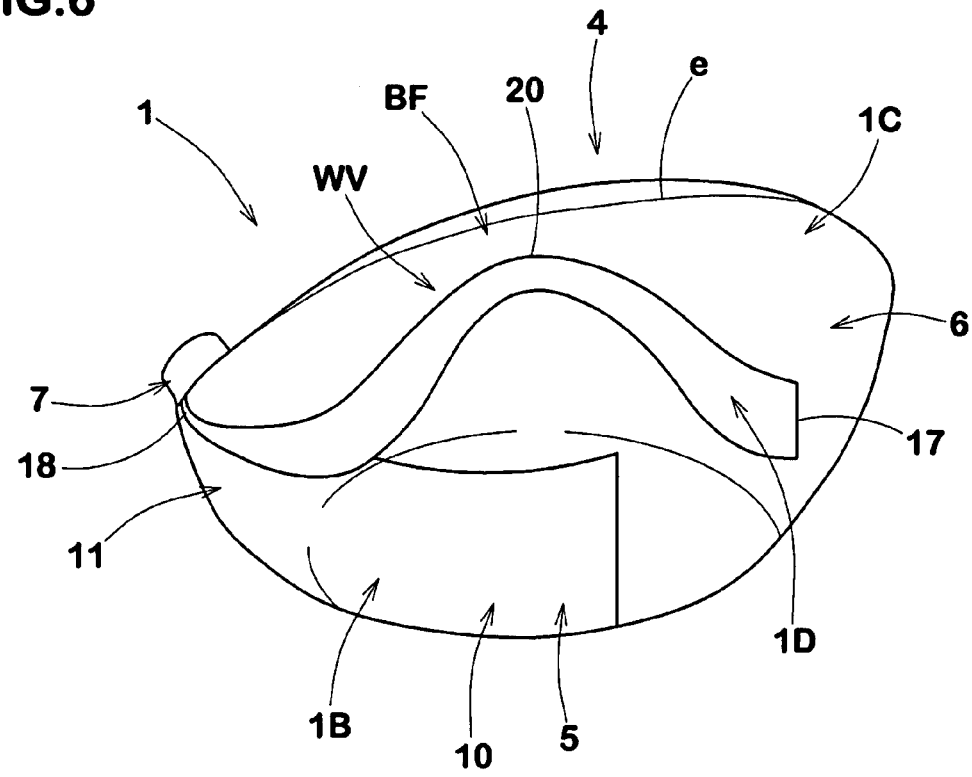
FIG. 6 is a rear view thereof.

The weighting component 1D in this example extends continuously between its toe-side end 17 and heel-side end 18 through the back face BF, and includes a part WV waving in the up-and-down direction as best shown in FIG. 6.

From the toe-side end 17 located at a relatively lower position, this wave part wv is gradually going up towards the back face BF, and at the rear end of the club head, it reaches to its peak 20 and most approaches to the boundary (e) between the crown portion 4 and side portion 6. Then, the wave part is gradually going down towards the heel, and reaches to its lowest point and then again going up until the heel-side end 18. Thus, the weighting component 1D in this example runs at a higher position on the backside BF of the head, but lower positions on the toe-side and heel-side. As a result, the center of gravity becomes deeper and lower and the moment of inertia can be increased.

Comparison Tests

Wood golf club heads (EX. 1 to 5, Ref. 1 to 3) of the same shape and same size (volume: 460 cc, Loft angle: 11 degrees, Lie angle: 57 degrees) were prepared and attached to identical FRP shafts (SRI sports Ltd. "MP200", flex R) to make 45-inch wood clubs, and the following comparison tests were conducted.

Each of the heads was made based on the structure shown in FIG. 1 to FIG. 8, and comprised a face component, a hosel-and-heel component and a rear component as explained above, and the face component and hosel-and-heel component were connected with each other by means of plasma welding, and then the assembly was fixed to the rear component by means of an adhesive agent.

<Face Component>

In Ex. 1 to Ex. 5 and Ref. 2 to Ref. 3, the face component was made of a titanium alloy having a specific gravity of 4.54 and comprising 4.0% of Al, 2.5% of V, 1.8% of Mo 1.7% of Fe and the balance being essentially Ti.

In Ref. 1, the face component was made of a titanium alloy having a specific gravity of 4.42 and comprising 6.0% of Al, 4.0% of V, and the balance being essentially Ti.

In each head, the face component was formed by die punching a rolled plate of the titanium alloy and then press molding the punched-out plate. The thickness tf of the face portion was 3.2 mm. The size F of the turnbacks was 10 mm.

<Hosel-and-Heel Component>

In EX. 1 to EX. 15 and Ref. 1 and Ref. 3, the hosel-and-heel component was made of a titanium alloy having a specific gravity of 4.42 and comprising 6.0% of Al, 4.0% of V, and the balance being essentially Ti.

In Ref. 2, the hosel-and-heel component was made of a magnesium alloy having a specific gravity of 1.81 and comprising 8.4% of Al, 0.6% of Zn, 0.3% of Mn and the balance being essentially Mg.

In each head, the hosel-and-heel component was formed by lost-wax precision casting. The thickness ts of the heel-side sole plate was 0.8 mm.

<Rear Component>

In Ex. 1 to Ex. 5 and Ref. 2 and Ref. 3, the rear component was made of a magnesium alloy having a specific gravity of 1.81 and comprising 8.4% of Al, 0.6% of Zn, 0.3% of Mn and the balance being essentially Mg.

In Ref. 1, the rear component was made of a titanium alloy having a specific gravity of 4.42 and comprising 6.0% of Al, 4.0% of V, and the balance being essentially Ti.

In each head, the rear component was formed by lost-wax precision casting. The thickness tc of the crown portion was 1.0 mm. The thickness tp of the rear part 6B of the side portion was 1.0 mm. The thickness of the rear part 5B of the sole portion was 1.0 mm.

<Weighting Component>

In Ex. 5, the weighting component made of a tungsten-nickel alloy was disposed.

Measurement of Weight of Hollow Structure

The weight of the face component, hosel-and-heel component and rear component was measured and the results are indicated by an index based on Ref. 1 being 100, wherein the smaller the value, the larger the weight margin.

Carry Distance Test

Each of the wood clubs was mounted on a swing robot, and hit three-piece balls ("XXIO" of SRI sports Ltd.) five times at the head speed of 40 m/s to obtain the average carry distance. The results are indicated in Table 1 by an index based on Ref. 1 being 100, wherein the larger the value, the longer the carry distance.

Sole Scratch Resistance Test

Increasing the head speed to 50 m/s, each of the wood clubs mounted on the swing robot hit the three-piece balls 500 times at the sweet spot 5. Thereafter, by the naked eye, the sole portion was checked for scratch and ranked in the order of less scratch, wherein the smaller the rank number, the better the scratch resistance.

Durability Test

After the scratch resistance test, the hitting test was continued up to 5000 times at the maximum, and every 100 hits the head was checked on the whole by the naked eye. If any damage was found, the test was stopped and the total number of the hits was recorded.

Directionality Test

Each of five golfers having handicap ranging from 5 to 15 hit the golf balls five times per each club and the difference from the target trajectory was measured. The results are indicated by an index based on Ref. 1 being 100, wherein the larger the value, the better the directionality of a hit ball.

The test results are shown in Table 1.

TABLE 1

| Club head | Ref. 1 | Ref. 2 | Ref. 3 | Ex. 1 | Ex. 2 | Ex. 3 | Ex. 4 | Ex. 5 |
|---|---|---|---|---|---|---|---|---|
| Hollow structure | | | | | | | | |
| Face component Material | Ti | Ti | Ti | Ti | Ti | Ti | Ti | Ti |
| Rear component Material | Ti | Mg | Mg | Mg | Mg | Mg | Mg | Mg |
| Hosel-&-heel component Material | Ti | Mg | Ti | Ti | Ti | Ti | Ti | Ti |
| Distance a (mm) *1 | — | — | −10 | 0 | 10 | 30 | 40 | 10 |
| Size b (mm) | — | — | 50 | 50 | 50 | 50 | 50 | 50 |
| Weight *2 | 100 | 88 | 93 | 93 | 93 | 93 | 93 | 93 |
| Weighting component | — | none | none | none | none | none | none | *3 |
| Directionality | 100 | 100 | 104 | 106 | 107 | 107 | 105 | 111 |
| Carry distance | 100 | 101 | 101 | 102 | 103 | 103 | 103 | 103 |
| Scratch resistance | 1 | 9 | 8 | 7 | 6 | 3 | 2 | 4 |
| Durability | | | | | | | | |
| Damaged? | no | yes | no | no | no | no | no | no |
| Number of hits | 5000 | 1900 | 5000 | 5000 | 5000 | 5000 | 5000 | 5000 |

*1) (−)minus means that the extreme end of the heel-side sole plate was positioned on the heel side the point SG.
*2) weight of the face component, hosel-and-heel component and rear component
*3) A weighting component having a length of 100 mm was disposed as shown in FIGS. 4-6.

From the test results, it was confirmed that the weight margins in Example heads Exs. 1 to 4 were remarkably increased when compared with Ref. 1. Example heads Exs. 1 to 4 were improved in the directionality when compared with Ref. 2. Example head Ex. 5 could be further improved in the directionality.

As described above, in the golf club head according to the present invention, a major part of the club head is formed by a magnesium alloy. Therefore, the weight margin is increased, without deteriorating the ball hitting sound. Further, at least the major part of the face portion, the major part of the sole portion and the hosel portion are made of the titanium alloy(s). Therefore, the durability of the head and the scratch resistance of the sole portion can be improved. Furthermore, as the major part of the sole portion is made of the titanium alloy as opposed to the magnesium alloy, lowering of the center of gravity is facilitated.

The present invention is suitably applied to wood-type hollow golf club heads. But, it is also possible to apply the present invention to another type such as iron-type and utility-type as far as the head has a hollow structure.

The invention claimed is:

1. A golf club head having a face portion of which a front face defines a clubface, a crown portion intersecting the clubface at the upper edge thereof, a sole portion intersecting the clubface at the lower edge thereof, a side portion between the crown portion and sole portion which extends from a toe-side edge to a heel-side edge of the clubface through a back face of the club head, and a hosel portion having a shaft inserting hole, the club head further comprising a face component made of a titanium alloy and forming a major part of the face portion, a hosel-and-heel component made of a titanium alloy and forming the hosel portion and a heel-side major part of the sole portion, and a rear component made of a magnesium alloy, and a strip-shaped weighting component, wherein said heel-side major part of the sole portion formed by the hosel-and-heel component extends towards the toe of the head to intersect a vertical straight line passing through the center of gravity of the club head, and said weighting component is disposed along an outer surface of the rear component and extends continuously from a toe-side end located at a toe-side point on the outer surface to a heel-side end located at a heel-side point on the outer surface through the back face, and said weighting component includes a wave part waving in the up-and-down direction such that, from said toe-side end located at a relatively low position, the wave part gradually goes up towards the back face, and at the rear end of the club head, it reaches to its peak, then, the wave part gradually goes down towards said heel-side end.

2. The golf club head according to claim 1, wherein the extreme end of said heel-side part in the heel-and-toe direction of the head is at a distance in a range of 5 to 40 mm in the heel-and-toe direction from the intersecting point of said vertical straight line and said heel-side part.

3. The golf club head according to claim 2, wherein the size of said heel-side part in the back-and-forth direction is in a range of 20 to 80 mm.

4. The golf club head according to claim 2, wherein the weighting component is made of a material having a specific gravity larger than that of said magnesium alloy, and in a range of from 7.0 to 20.0.

5. The golf club head according to claim 1, wherein the size of said heel-side part in the back-and-forth direction is in a range of 20 to 80 mm.

6. The golf club head according to claim 5, wherein the weighting component is made of a material having a specific gravity larger than that of said magnesium alloy, and in a range of from 7.0 to 20.0.

7. The golf club head according to claim 1, wherein the weighting component is made of a material having a specific gravity larger than that of said magnesium alloy, and in a range of from 7.0 to 20.0.

8. The golf club head according to claim 1, wherein said outer surface of the rear component is provided with a recessed part accommodated to the weighting component, and the weighting component is fitted in the recessed part and bonded thereto by the use of an adhesive agent.

* * * * *